United States Patent [19]

Theurer et al.

[11] Patent Number: 4,502,389

[45] Date of Patent: Mar. 5, 1985

[54] TRACK WORK TRAIN

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 283,458

[22] Filed: Jul. 15, 1981

[30] Foreign Application Priority Data

Jul. 24, 1980 [AT] Austria ..... 3845/80
Feb. 6, 1981 [AT] Austria ..... 556/81

[51] Int. Cl.[3] ..... E01B 27/00; E01B 27/02; E01B 27/08

[52] U.S. Cl. ..... 104/2; 104/12; 171/16; 37/104

[58] Field of Search ..... 104/2, 3, 7 A, 7 R, 104/12; 171/16; 37/104, 105, 106, 107

[56] References Cited

U.S. PATENT DOCUMENTS

| | | | |
|---|---|---|---|
| 3,872,929 | 3/1975 | Theurer et al. | 171/16 |
| 4,004,524 | 1/1977 | Scheuchzer et al. | 104/3 |
| 4,160,418 | 7/1975 | Theurer | 104/2 |
| 4,178,995 | 12/1979 | Theurer et al. | 104/2 |
| 4,263,851 | 4/1981 | Theurer et al. | 104/2 |
| 4,270,456 | 6/1981 | Theurer et al. | 104/3 |
| 4,319,416 | 3/1982 | Scheuchzer et al. | 104/7 R |
| 4,357,874 | 11/1982 | Theurer | 104/2 |

FOREIGN PATENT DOCUMENTS

| | | | |
|---|---|---|---|
| 307476 | 9/1972 | Austria . | |
| 341564 | 6/1977 | Austria . | |
| 2313055 | 9/1974 | Fed. Rep. of Germany | 104/3 |
| 2228196 | 7/1978 | Fed. Rep. of Germany . | |
| 1169721 | 11/1969 | United Kingdom . | |
| 1174930 | 12/1969 | United Kingdom . | |

*Primary Examiner*—Randolph Reese
*Assistant Examiner*—Dennis Rodgers
*Attorney, Agent, or Firm*—Kurt Kelman

[57] ABSTRACT

A track work train for successively reconditioning ballast bed zones supporting respective assembled track section comprises a track building vehicle and a plurality of freight cars interconnected for common movement along the track. The track building vehicle includes an elongated frame and two undercarriages supporting the vehicle frame for movement on the track. A hoist is mounted on the vehicle frame for lifting an assembled track section off the ballast bed and the vehicle frame spans a ballast bed reconditioning zone resulting from the lifting of the assembled track section off the ballast bed. A vertically adjustably ballast bed excavator is mounted on the vehicle frame adjacent the hoist and a conveyor band is associated with the excavator. The hoist and the excavator with the associated conveyor band are displaceably mounted on a guide track on the vehicle frame for movement along the vehicle frame in the direction of the track.

25 Claims, 9 Drawing Figures

TRACK WORK TRAIN

Figures 1, 2, 3:
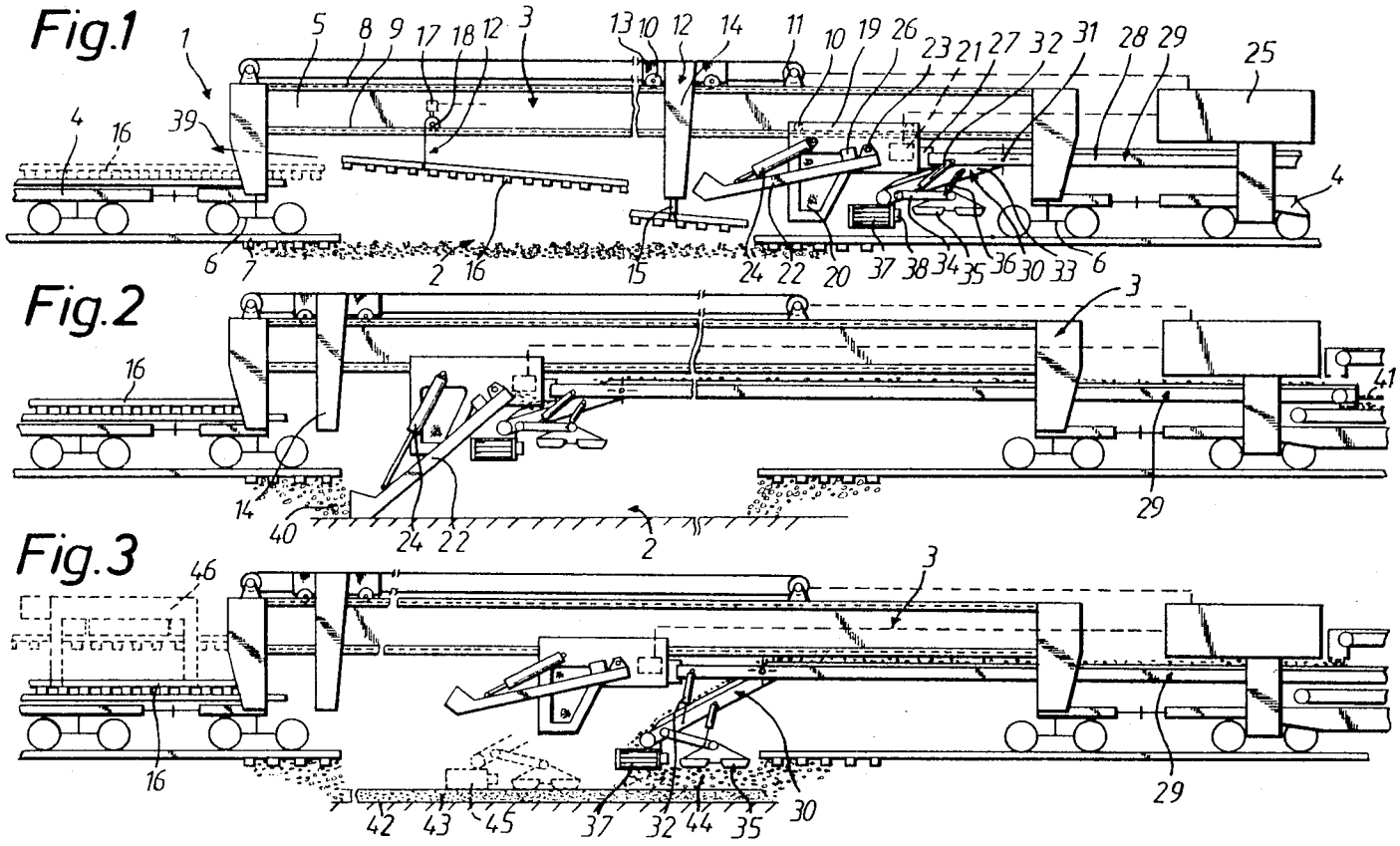

The present invention relates to a track work train comprising a track building vehicle and a plurality of freight cars interconnected for common movement along the track, the track building vehicle including an elongated frame extending in the direction of the track and two undercarriages spaced apart in this direction and supporting the vehicle frame for movement on the track, as well as to a method of successively reconditioning ballast bed zones supporting respective assembled track sections and resting on layers of sand.

Austrian Pat. No. 307,476, of May 25, 1973, discloses a ballast cleaning machine in which a protective synthetic resin sheet is applied to the sub-grade during cleaning of the ballast. A supply roll of the sheeting is carried on the machine and is continuously unrolled in the ballast bed reconditioning zone which is bounded at one end by a ballast excavating chain passing below the assembled track section and, at its other end, by a ballast delivery unit. After the space between the unrolled protective sheet on the sub-grade and the assembled track section has been filled with ballast from the ballast delivery unit, the track bed is protected against softening of the sub-grade. The waste from the cleaned ballast is conveyed to freight cars which may be coupled to the ballast cleaning machine.

U.S. Pat. No. 3,872,929, dated Mar. 25, 1975, describes a method and apparatus for stabilizing the sub-grade of a railroad ballast bed in which the sub-grade is stabilized by depositing sand on the bed, removing the sand and ballast in admixture with an excavating chain until the sub-grade has been exposed and the sand and ballast are separated from each other on a screen which receives the admixture. Two endless conveyors below the screen convey the separated sand and ballast to the exposed sub-grade to deposit the separated sand thereat at a point ahead of a succeeding point where the separated ballast is deposited thereover so that a layer of sand is interposed between the sub-grade and the ballast as a protection of the sub-grade. This ballast bed reconditioning system has proved to be quite effective but usually requires a preliminary cleaning of the ballast which has been intermingled with the mud from the upwardly pressing sub-grade. Furthermore, the admixture of the ballast and sand requires the sand to have a certain fluidity for the subsequent separation so that the procedure depends on weather conditions permitting the same to stay fluid.

In British Pat. No. 1,169,721, published Nov. 5, 1969, a vertically displaceable ballast excavating unit is mounted on a chassis for removing the ballast from the bed. The sole function of this machine is to remove all of the ballast from the track bed, including the shoulders, and then to shape the ballast bed. The machine cannot be used for reconditioning the bed.

U.S. Pat. No. 4,160,418, dated July 10, 1979, deals with a track renewal train equipped for continuous replacement of track rails and ties. The train has a first section moving on the old track and a second section moving on the new track. An intermediate train section consisting of a carrier frame spans a trackless intermediate right of way section in which the ballast is removed, cleaned and redistributed. The ballast excavator is fixedly mounted on the carrier frame and the track rails and individual ties are separately removed and laid in the intermediate right of way section. There is no handling of assembled track sections in this system.

British Pat. No. 1,174,930, published Dec. 17, 1969, discloses a method and apparatus for improving the strength of a railroad bed sub-grade with a mobile machine on which augurs are mounted for digging out parts of the ballast bed and subgrade material and material is then injected and consolidated to strengthen the sub-grade.

German patent specification No. 2,228,196, published July 20, 1978, discloses a train carrying a plurality of assembled track sections and cranes for removing old track sections and replacing them with new ones.

U.S. Pat. No. 4,270,456, dated June 2, 1981, describes a mobile apparatus for replacing assembled track sections. The apparatus comprises an elongated overhead girder extending above a transport vehicle or vehicles and projecting beyond an end thereof. A guide track extends in a transport plane along the girder and a trolley is mounted on the guide track for movement therealong. The trolley includes a vertically adjustable hoist for lifting and lowering a respective track section and for conveying it along the guide track. Gantry supports for the girder project laterally beyond the longitudinally extending sides of the vehicle(s) for leaving therebetween a transverse space permitting the passage of an assembled track switch section therethrough. The gantry supports include supports mounting the girder on the vehicle(s) and vertically adjustably supporting the projecting part of the girder on the ballast bed. There is no ballast bed reconditioning.

It is the primary object of the present invention to provide a track work train for successively reconditioning ballast bed zones supporting respective assembled track sections and resting on protective layers of sand on a sub-grade, which is particularly simple in structure and which improves the ballast bed reconditioning, particularly with respect to the distribution of the protective sand layer and the ballast bed.

The above and other objects are accomplished in a track work train of the first-described type according to this invention by mounting hoist means on the vehicle frame between the undercarriages and capable of lifting an assembled track section off a ballast bed supporting the track and resting on a layer of sand on a sub-grade, the vehicle frame spanning a ballast bed reconditioning zone resulting from the lifting of the assembled track section off the ballast bed. Furthermore, a vertically adjustable ballast bed excavating means is mounted on the vehicle frame adjacent the hoist means and a conveyor band is associated with the excavating means. Guide track means as well as the excavating means and the associated conveyor band for movement along the vehicle framed in the direction of the track and drive means are provided for displacing the hoist means and the excavating means, and means is provided for discharging, distributing and consolidating ballast and sand in the ballast bed reconditioning zone.

In an unexpectedly simply manner, such a track work train with a single track building vehicle enables the equipment on the vehicle to be utilized rationally and advantageously so as to effect all the reconditioning operations. The displaceable mounting on guide tracks of the vehicle enables the excavating means as well as the track section hoist means to be suitably maneuvered to any desired point in the reconditioning zone and beyond without the need of taking the track building vehicle off the track and then placing it on the track again. The guide tracks extending above the undercarriages supporting the vehicle frame make accurate leveling with the ballast excavating and consolidating means possible. The numerous operations required for the ballast bed reconditioning can be effected in a smooth work flow on the train while the train itself remains stationary during each reconditioning stage while the working equipment is suitably displaced along the train. The machine structure is very simple and accordingly economical. Also, the conveying and distributing means arrangement enables the protective layer of sand and the bedding ballast to be applied clearly separated from each other while each separate layer is entirely homogenous. Since the sand and ballast are delivered and deposited separately, they cannot stick togther so that the reconditioning may proceed even in a damp environment.

According to another aspect of this invention, a method is provided for successively reconditioning ballast bed zones supporting respective assembled track sections and resting on layers of sand, which comprises the steps of moving the track work train along the track until the track building vehicle has reached a respective ballast bed zone and stopping the train when the vehicle frame spans this zone between the two undercarriages. The assembled track section in this zone is lifted off the ballast bed, the lifted assembled track section is displaced along the track building vehicle in the direction of the track to a respective freight car and the displaced assembled track section is supported on this freight car. The ballast is excavated in this zone with the excavating means displaced in the indicated direction along the track building vehicle, the excavated ballast is conveyed to containers carried by respective ones of the freight cars and the excavated ballast is deposited in these containers. Sand and ballast carried on respective ones of the freight cars are successively conveyed to the excavated ballast bed zone. The sand and the ballast conveyed to the ballast bed zone are consolidated and planed with consolidating and planing devices displaced in the indicated direction along the track building vehicle, an assembled track section is then moved from the one freight car back to, and along, the track building vehicle, and the assembled track section is lowered onto the ballast bed.

Compared to known automatic methods of reconditioning a ballast bed, the method of the invention provides an improved ballast bed reconditioning method based on the assembly line principle. The old ballast bed is entirely removed and homogenous sand and ballast layers are applied in succession in the excavated zone to provide a very strong and lasting railroad track bed. The sand and the ballast are stored in separate containers and delivered separately to the excavated zone so that full separation of the two homogenous layers is assured. Since the excavating as well as the consolidating and planing means are displaced along guide tracks on a stationary track building vehicle, the resultant ballast bed is accurately leveled.

Figure 4:
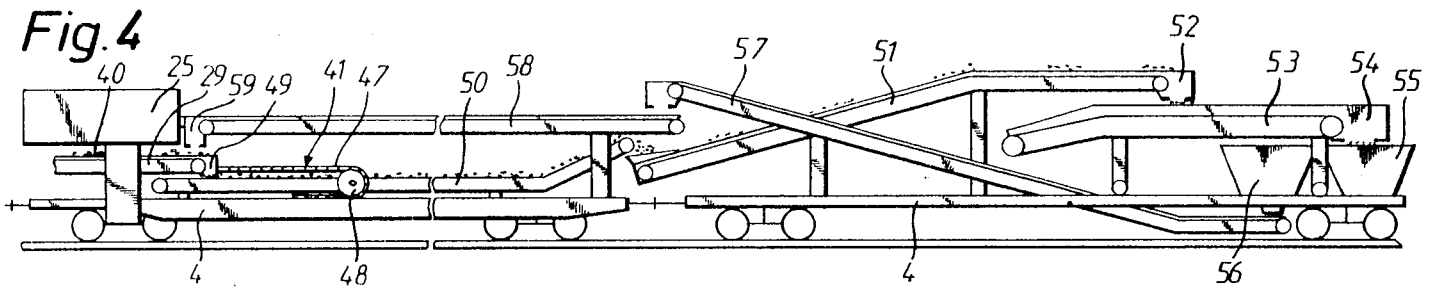
Figure 5:
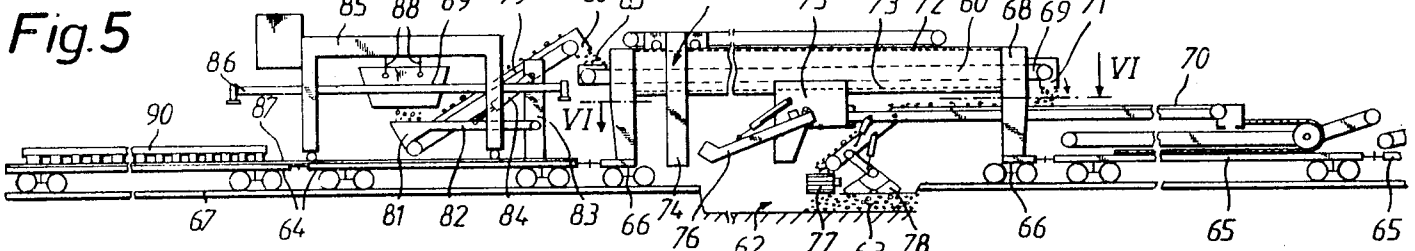
Figure 6:
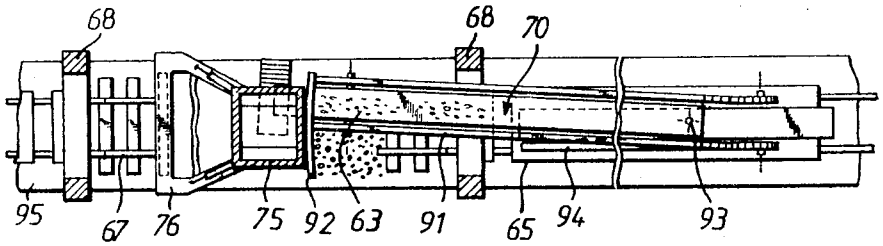

The above and other objects, advantages and features of the present invention will become more apparent from the following detailed description of certain now preferred embodiments thereof, taken in conjunction with the accompanying schematic drawing wherein FIGS. 1, 2 and 3 show a portion of a track work train according to this invention in side elevation, the three figures illustrating the ballast bed reconditioning equipment in different operating stages, FIG. 4 shows another portion of the train in side elevation, one end of this train portion being seen at the right of the track building vehicle in FIGS. 1 to 3, FIG. 5 is similar to FIG. 3 and shows another embodiment, FIG. 6 is a top view of the embodiment of FIG. 5, partially in section along line VI—VI of FIG. 5, and FIGS. 7 to 9 are similar to FIGS. 1 to 3 and show a preferred embodiment of the track building vehicle.

Referring now to the drawing and first to FIG. 1, there is shown track work train 1 comprising track building vehicle 3 and a plurality of freight cars 4 interconnected for common movement along track 7. The track building vehicle includes elongated frame 5 extending in the direction of the track and two undercarriages 6, 6 spaced apart in this direction and supporting vehicle frame 5 for movement on track 7. Hoist 12 is mounted on the vehicle frame between the undercarriages and is capable of lifting assembled track section 16 off a ballast bed supporting track 7 on a layer of sand on a sub-grade. The vehicle frame spans ballast bed reconditioning zone 2 resulting from the lifting of the assembled track section off the ballast bed. Vertically adjustable ballast bed excavating mechanism 22 is mounted on vehicle frame 5 adjacent hoist 12 and conveyor band 29 is associated with the excavating mechanism. Upper and lower guide tracks 8 and 9 on vehicle frame 5 respectively mount hoist 12 and excavating mechanism 22 and the associated conveyor band displaceably for movement along the vehicle frame in the direction of track 7. Compacting and planing units 35 and 37 discharge, distribute and consolidate ballast and sand in the ballast bed reconditioning zone.

Hoist 12 and excavating mechanism 22 are mounted on rollers 10 for movement along the respective guide tracks. Mounting the hoist on the upper guide track and the excavating mechanism on the lower guide track has the advantage of reducing the torque acting on guide track 9 for the excavating mechanism which extends more deeply into the reconditioning ballast bed zone than the hoist.

Mounting the hoist and excavator on separate guide tracks provides a robust construction which prevents overloading of each track and independent displacement of the hoist and excavator.

Conveyor band 29 has an input and connected to the ballast bed excavating mechanism and, as shown in FIG. 2, a length at least equal to the distance between undercarriages 6, 6. This has the advantage that the excavated ballast may be readily conveyed to an adjacent freight car despite the displacement of the excavating mechanism with the associated conveyor band along vehicle frame 5 over the entire length of ballast bed reconditioning zone 2.

Hoist 12 is comprised of two carriers 14 at respective sides of vehicle frame 5 and joined by cross beam 13 forming a trolley on which rollers 10 are mounted, cable drive 11 being attached to the trolley for displacing the hoist along track 8. Gripping elements 15 are mounted for vertical displacement in corresponding guide tracks on carriers 14 of hoist 12 and are capable of engaging assembled track section 16 for lifting and lowering the track section.

The hoist further comprises winch 18 operated by drive 17 and displaceable along lower guide track 9 for holding another part of assembled track section 16 during lowering and lifting.

In the illustrated embodiment, carrier frame 19 including operator's cab 20 supports ballast excavating means 22, the carrier frame running on rollers 10 along lower guide track 9 for displacement in the direction of the track. Associated conveyor band 29 is also supported on carrier frame 19. In addition, the carrier frame supports ballast planing device 37 and ballast compacting device 34 for common movement along the lower guide track, ballast and sand being discharged, distributed and consolidated in the ballast bed reconditioning zone 2 by these devices. In this manner, the entire assembly may be moved by single drive 21 operating rollers 10 and the indicated mechanisms are held at a constant distance from each other.

Ballast excavating means 22 is a generally conventional excavating chain widely used in ballast cleaning machines and is vertically adjustably mounted on carrier frame 19, being pivotal about pivot axis 23 extending transversely to the track. Drive 24 has respective ends linked to carrier frame 19 and excavating means 22 for vertically adjusting the excavating means. The excavating chain is driven by drive 26 and central power plant 25 is connected to the various drives for supplying power thereto, the illustrated drives being hydraulically operated and the power plant including a source of hydraulic fluid supplied to the drives for operating the same.

In the illustrated embodiment, conveyor band 29, planing device 37 and compacting device 34 are supported on support frame 28 for transverse displacement, the support frame being mounted on carrier frame 19 for movement along transverse guide track 27. The conveyor band has portion 30 adjacent an input end of the conveyor band adjacent excavating means 22. Conveyor band portion 30 is pivotal in a vertical plane about pivot axis 31 extending transversely to the track and may be vertically adjusted by drive 32 linked to support frame 28. Support frame 33 carries conveyor band portion 30 and ballast compacting device 35 is vertically adjustably mounted on support frame 33 by lever arm 34 one end of which is connected to support frame 33 while its other end carries the ballast compacting device. Drive 36 has respective ends linked to lever arm 34 and support frame 33 of conveyor band portion 30 for vertical adjustment of the ballast compacting device. The transverse displacement of the planing and compacting devices enables these devices to work over the active, relatively wide bed.

Ballast planing device 37 is arranged forwardly of the compacting device and extends transversely of the track over the entire width of the ballast bed. This planing device consists essentially of a chain driven by drive 38 transversely of the track.

FIG. 1 shows assembled track section 16 in the process of being lifted in full lines while it is shown in broken lines stored on freight car 4 to the left of ballast bed reconditioning zone 2 after it has been lifted and transported in the direction indicated by arrow 39 by displacement of the hoist along guide track means 8, 9. For reasons of space, the lengths of the reconditioning zone 2, assembled track section 16 and track building vehicle 3 have not been shown in the actual proportion, the reduction in length being indicated by the indicated breaks in the track building vehicle and the assembled track section.

In FIG. 2, train 1 is shown in the same position as in FIG. 1 relative to ballast reconditioning zone 2 but after the assembled track section has been lifted off the ballast bed and moved out of this zone. Carrier frame 19 has been moved forwardly, i.e. all the way to the left of the ballast reconditioning zone in FIG. 2, and excavating means 22 has been lowered into ballast 40 for removing the ballast down to sub-grade 42, the excavated ballast being carried by the excavating chain to the input end of conveyor band 29 which is operated for conveying the excavated ballast to rear freight cars 4, as will be more fully explained in connection with FIG. 4. As shown, the input end of conveyor band 29 is associated with planing device 37 and the conveyor band has an output end projecting beyond track building vehicle 3 in the direction of the track. Longitudinal displacement drive means 41 for displacing the excavating means and the associated conveyor band is arranged at the output end and, as shown in FIG. 4, additional conveyor band 50 is mounted on a respective freight car 4 connected to the track building vehicle, the output end of conveyor band 29 being associated with additional conveyor band 50. Drive 41 assists drive 21 in the displacement of the entire assembly of ballast excavating, conveyor, planing and compacting means, which assembly may be used for removing the old ballast when the conveyor band is moved in one direction while it may be used for delivering sand and new ballast when the conveyor band movement direction is reversed. In the preferred embodiment shown herein, drive 41 is a chain drive. The association of additional conveyor band 50 with the output end of conveyor band 29 enables conveyor band 29 to be telescopically extended without any interruption of the conveyance during operation. The arrangement of compacting device 35 immediately adjacent planing device 37 enables the sand and ballast delivered to the reconditioning zone by conveyor band 29 to be planed and immediately thereafter to be compacted. Since the planing and compacting devices are mounted at the input end of conveyor band 29 on vertically adjustable conveyor band portion 30, they may be readily correctly positioned by a single vertical adjustment. To carry away the old excavated ballast, conveyor band portion is pivoted upwardly to the output end of the ballast excavator chain. Thus, conveyor band 29 may be used for removing the excavated ballast and for delivering the new sand and ballast for distribution in reconditioning zone 2.

FIG. 3 illustrates this reconditioning zone after protective sand layer 43 has been applied to sub-grade 42 and after a portion of new ballast bed 44 has been laid on the protective sand layer and has been planed by device 37 and compacted by device 35. The broken-line position of planing device 37 and compacting device 35 indicates the position of these devices when sand 43 is distributed, planed and compacted in a first reconditioning step.

On the left side of FIG. 3, a gantry crane 46 is shown in broken lines to indicate a possible means for displacing assembled track sections along a series of freight cars 4 connected at one end of track building vehicle 3, such a gantry crane being used to move away an old assembled track section and to deliver a new assembled track section from one of the freight cars on which such track sections are stored.

As shown in FIG. 4, a second series of freight cars 4 is connected to an end of track building vehicle 3 opposite to the one end and ballast and sand conveyor means 50, 51 and 53 are mounted the second series of freight cars. This arrangement provides for a smooth work flow despite the multitude of reconditioning operations and the rather extensive movement of material from and to the reconditioning zone. The old ballast as well as the sand and new ballast are stored at one end of the train whereto and whence they are moved on one series of freight cars while the assembled track sections are stored and moved at the other end of the train without any interference of the various movements with each other.

Illustrated longitudinal displacement drive 41 consists of two laterally arranged chains 47 having one end affixed to conveyor band 29 while their other end is trained over sprockets 48 and is attached to freight car 4. The sprockets are longitudinally displaceable on the freight car. Feed hopper 49 is associated with the output end of conveyor band 29 and conveyor band 50 is mounted below the feed hopper between chains 47 and sprockets 48. Conveyor band 50 has a length corresponding at least to the length of ballast bed reconditioning zone 2 and another conveyor band 51 adjoins conveyor band 50, feed hopper 52 being associated with the output end of conveyor band 51. Further conveyor band 53 is mounted below feed hopper 52 on an adjoining freight car 4, the entire conveyor apparatus extending longitudinally of the train in the direction of the track. Containers 55 may be moved below feed hopper 54 at the output end of conveyor band 53 to receive the excavated ballast conveyed along the second series of freight cars 4 by conveyor bands 50, 51 and 53. Containers 56 respectively filled with sand and new ballast are moved to one of the freight cars into alignment with an input end of another elongated conveyor band 57, and an outlet opening of container 56 discharges the sand or ballast to conveyor band 57 whose output end delivers the sand or ballast to elongated conveyor band 58 arranged above longitudinally displaceable conveyor band 29. When this conveyor band is fully displaced outwardly of the reconditioning zone, feed hopper 59 associated with the output end of conveyor band 58 delivers the sand or new ballast to conveyor band 29. Guide tracks (not shown) on freight car 4 connected to the track vehicle building guide the projecting end of conveyor band 29 during the longitudinal displacement.

In the embodiment of FIG. 5, track building vehicle 60 of train 61 spans ballast bed reconditioning zone 62. In the working direction, the track building vehicle is preceded by freight car 64 which supports gantry crane 85 on which container 89 for sand or new ballast is mounted, the track building vehicle being followed by freight car 65 which receives the excavated ballast. Conveying apparatus 69 spans reconditioning zone 62 and has an input end for receiving new ballast 63 (or sand). Conveying unit 79 is arranged on freight car 64 and has a delivery end constituted by feed hopper 80 associated with the input end of conveying apparatus 69 which has an output end constituted by feed hopper 71 arranged above conveyor band 70. In this arrangement, the sand and new ballast are delivered from the same end of train 61 on which assembled track sections 90 are stored. Accordingly, more space is available at the other end of the train for storing the excavated ballast and, in addition, the coveying paths are simplified.

Conveyor belt 70 is mounted on elongated frame 68 of track building vehicle 60 and two undercarriages 66, 66 spaced part in the direction of track 67 support the vehicle frame for movement on the track. Hoist means 74 for the assembled track section is mounted on the vehicle frame between the undercarriages and is displaceable along upper guide track 72, and ballast excavating means 76 with planing device 77 and compacting device 78 are displaceable along lower guide track 73 which supports carrier frame 75 for the ballast excavating, planing and compacting means, all in the same manner as described hereinabove in connection with the embodiment of FIGS. 1 to 3.

Collecting hopper 81 is pivotally connected through lever arm 82 to support 83 affixed to freight car 64 and pivoting drive 84 is linked to the lever arm for pivoting the collecting hopper. An outlet in container 89 is arranged to discharge new ballast or sand into the collecting hopper for delivery to conveying unit 79.

Gantry crane 85 vertically adjustably carries container 89 by means of winches 88 and also supports track section carrying frame 86. The gantry crane runs on rails 87 along a series of freight cars 64 for selectively picking up or depositing assembled track sections 90 and containers 89. Neither reconditioning zone 62 nor the series of rear freight cars 65 for carrying the excavated ballast are shown in their full length.

The diagrammatic plan view of FIG. 6 shows conveyor band 70 mounted with its supporting frame 91 in transverse guide track 92 for transverse displacement, vertical pivot 93 supporting an end of the conveyor band opposite the input end thereof for displacing the conveyor band in a horizontal plane. The opposite end of conveyor band 70 is guided longitudinally in the direction of track 67 in guide track 94 on freight car 65. The ballast bed on which track 67 rests is supported on sub-grade 95.

The operation of the track work train will partly be obvious from the above description of its structure and will be set forth in more detail hereinafter:

After the train has been driven along track 7 and 67 into a position wherein track building vehicle 3 or 60 is centered above ballast bed reconditioning zone 2 or 62, the train is stopped. Gripping elements 15 and winches 18 of hoist 12 are then lowered and the assembled track section to be lifted off the ballast bed is clamped thereto. The assembled track section is then lifted and the lifted track section is moved in the direction of arrow 39 to deposit this track section on one of the freight cars 4. After winches 18 have arrived at the end of lower guide track 9, they are disengaged as a front end of the track section is supported on the flat bed of freight car 4. Hoist 12 is further displaced to move the supported assembled track section completely onto car 4, gripping elements 15 are disengaged and hoist 12 is left in its end position adjacent car 4. Thus, with the train stopped when the vehicle frame spans the ballast bed zone between the two undercarriages, the assembled track section in the zone lifted off the ballast bed, displaced along the track building vehicle to a respective freight car and supported on the freight car, the work train is ready for excavating the ballast in this zone. For this purpose and even before the track section lifting, moving and storing operation has been entirely completed, carrier frame 19 supporting the ballast excavating means is displaced along the track building vehicle in the direction of the track. The carrier frame is moved on rollers 10 along lower guide track 9 or 73 under the power of drive 21. When the ballast excavator chain arrives in the reconditioning zone, it is lowered by the operator in cab 20 and excavator chain drive 26 is switched on to excavate the ballast. Conveyor band 19 or 70, planing device 37 or 77 and compacting device 35 or 78 are displaced together with the ballast excavator along the lower guide track. Pivotal conveyor band portion 30 of the conveyor band and the planing and compacting devices remain in the same position throughout the ballast excavating operation. Old ballast 40 is excavated and is ejected at the upper end of the excavating chain onto conveyor band portion 30 and the excavated ballast is removed from the reconditioning zone and conveyed to containers 55 where it is deposited. After reconditioning zone 2 or 62 has been completely cleared of ballast, the longitudinal displacement of the excavating means and its associated conveyor band is stopped and the excavating means is raised by drive 24, whereupon carrier frame 19 or 75 is returned to its starting position by drive 21 in conjunction with longitudinal displacement drive 41.

As shown in FIG. 3, sand and ballast are now successively conveyed from respective ones of the freight cars to the excavated ballast bed zone. For this purpose, drive 32 is actuated to lower conveyor band portion 30 until planing device 37 has reached the desired vertical position for distributing the sand or ballast and for planing the distributed sand or ballast. First, protective sand layer 43 is laid on sub-grade 42 and the depth of this protective layer is determined by the distance between the bottom of planing device 37 and sub-grade 42. Conveyor band 29 is driven in a direction opposite to that in which it was driven to carry away the excavated ballast and receives sand from containers 56 by way of elongated conveyors 57 and 58, the sand dropping through the driven chain of planing device 37 and being planed by the driven chain. Drive 36 is then actuated to lower compacting device 37 onto the planed sand (see broken lines in FIG. 3) and the compacting device is vibrated to consolidate the sand layer. After reaching the end of the ballast bed reconditioning zone, drive 32 is actuated again to lift conveyor band portion 30 with planing device 37 and compacting device 35 and carrier frame 19 is moved back to its starting position. The just described operation is now repeated with delivery of new ballast instead of sand, the planing and compacting devices 37 and 35 being lowered to the level on which the ties of the replaced track section are to be supported.

While the ballast bed has been reconditioned in the above-described manner, assembled track section 16 lifted off the ballast bed may be replaced by a new assembled track section, such track sections being stored on respective freight cars on the train and being transported therealong by gantry crane 46 in a manner well known and forming no part of the present invention. The assembled track section on freight car 4 is then moved from the freight car back to, and along, the track building vehicle and is lowered onto the ballast bed by the hoist. This return movement of the assembled track section may be accompanied by a like return movement of carrier frame 19 to its starting position. This ballast bed reconditioning cycle is then repeated at the next zone to which train 1 is moved.

In this manner, a very durable track bed is created in an assembly line procedure. In the embodiment of FIGS. 1 to 4, the lifted assembled track section is displaced towards one end of the track building vehicle and the ballast and sand are conveyed towards the end of the track building vehicle opposite to the one end, respective ones of freight cars 4 being connected to the ends of the track building vehicle. The opposite end of track building vehicle 3 is a leading end with respect to the operating direction of train 1. In this way, the conveying paths are relatively short and the structure is simple. Where a gantry crane is provided for replacing used assembled track sections by new track sections, the reconditioned track is completely renewed with a minimal additional cost. The new assembled track sections are stored on a respective freight car 4 connected to the one end of the track building vehicle, the lifted track section is interchanged for the new track section by means of the gantry crane displaceable along the freight cars, and the new track section is moved to, and along, the track building vehicle to the reconditioned ballast bed.

As shown in FIG. 4, excavated ballast 40 is moved by excavating chain 22 to conveyor band 29 which discharges the excavated ballast through feed hopper 49 to conveyor band 50. During the excavating phase, longitudinal displacement drive 41 remains inoperative and the assembly of ballast excavating means 22 and associated conveyor band 29 is moved solely by drive 21 which displaces carrier frame 19 along guide track 9. Conveyor band 50 carries the excavated ballast to adjacent conveyor band 51 which discharges it through feed hopper 52 onto another conveyor band 53 which is displaceable longitudinally of the train. Conveyor band 53 discharges the excavated ballast through feed hopper 54 into container 55 on freight car 4. Successive ones of such containers are moved into position under feed hopper 54 after each container has been filled with excavated ballast and these containers are carried along on the series of freight cars at this side of the track building vehicle.

After all the ballast has been excavated from the ballast bed reconditioning zone, carrier frame 19 is returned by drive 21 in cooperation with drive 41 to the starting position (at the right of FIGS. 1–3). Containers 56 storing sand now begin to deliver sand through conveyor bands 57 and 58 to conveyor band 29 whose movement is reversed to carry the sand to planing device 3. After layer of sand 43 has been laid on sub-grade 42 in the reconditioning zone, and the sand has been planed and compacted, the operation is repeated by placing containers 56 filled with new ballast at the input end of conveyor band 57. For a smooth operation, conveyor bands 50 and 58 respectively arranged below and above conveyor band 29 must be slightly longer than ballast bed reconditioning zone 2 and, hence, the displacement path of conveyor band 29.

In the embodiment of FIGS. 5 and 6, the new track bed material (sand and ballast) is brought to reconditioning zone 62 from front freight car 64. Container 89 is vertically adjustably suspended by winch 88 on gantry crane 85 for delivering the sand or ballast to conveyor unit 79 which carries it to conveyor unit 70 extending over the entire length of track building vehicle 60. The gantry crane is also used, like crane 46, for moving assembled track sections 90. During the movement of the track sections, conveyor unit 79 is raised by displacement drive 84 so that the track section may be moved below the raised conveyor unit. The excavated ballast is removed to the other side of the track building vehicle in the same manner as described hereinabove in connection with FIG. 4.

If desired and as is well known, a ballast cleaning screen may be carried on one of freight cars 4 for receiving the excavated ballast and cleaning it for return to the reconditioned ballast bed. Such an arrangement dispenses with the need for carrying new ballast on the train.

To enable planing device 77 to work on the shoulders of subgrade 95 beyond the ballast bed, one end of conveyor band 70, which carries the planing device, may be transversely moved about vertical pivot 93 at the opposite end of the conveyor band along guide track 92. Complete work on the sub-grade requires two operations first over one half of the sub-grade and then over the other half to establish the required sub-grade inclination. Thus, the entire sub-grade may be worked with planing and compacting devices whose width corresponds to the narrower width of the ballast bed.

Figures 7, 8, 9:
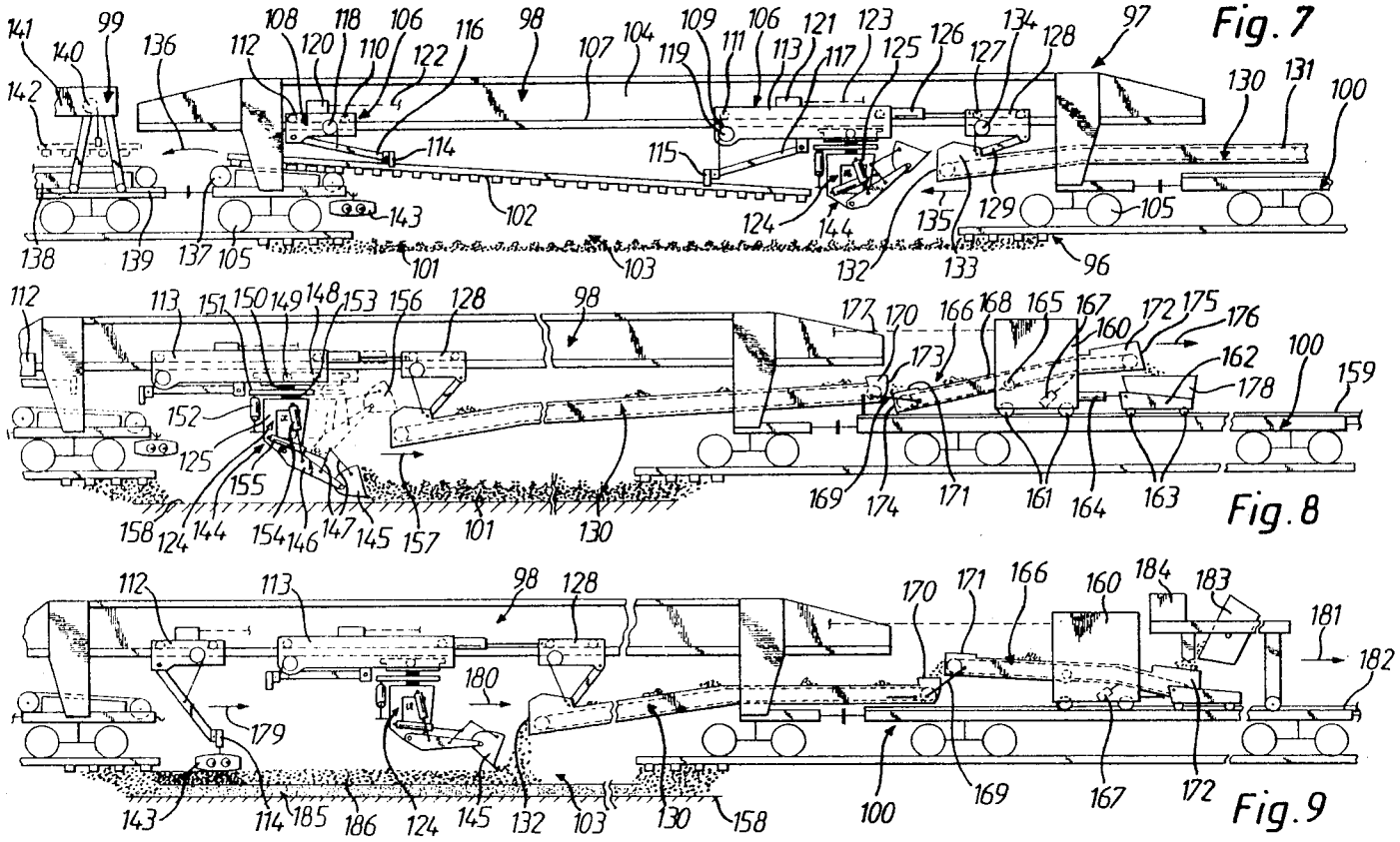

FIGS. 7 to 9 show another preferred embodiment of a track work train according to the present invention. Train 97 consists of track building vehicle 98 and respective series of freight cars 99 and 100 connected to respective ends of the track building vehicle. The train runs on track 96 resting on ballast 101 and is stopped with the track building vehicle spanning ballast bed reconditioning zone 103 created when assembled track section 102 is lifted off the ballast bed. Elongate frame 104 of the track building vehicle spans the reconditioning zone and is supported on track 96 by undercarriages 105, 105 wherebetween the reconditioning zone extends.

In this embodiment, the assembled track section hoist means 106 comprises two independently displaceable and vertically pivotal lifting devices 108 and 109, the lifting devices being independently longitudinally displaceable along guide tracks 107 arranged on respective sides of frame 104. Carriage 112 supports lifting device 108 on the guide track while the other lifting device 109 is supported on carriage 113 for a bucket loader to be described hereinafter. Each lifting device has one end linked to a respective carriage adjacent tracks 107 and an end opposite to the one lifting device end is equipped with clamping means 114, 115 for gripping assembled track section 102. Respective winch 118, 119 is mounted on a respective one of the carriages for pivoting each lifting device in relation to the carriage supporting the lifting device. This arrangement is distinguished by its very simple, yet robust construction capable of withstanding severe stresses. Since one of the lifting devices is carried by the bucket loader carriage, a single common drive can be provided and the arrangement allows for simpler control and clearer observation.

The lifting devices are comprised of pivotal arms 116, 117 whose free ends carry gripping jaws 114, 115 and which are connected by winches 118, 119 to carriages 112, 113. The carriages are longitudinally displaceable along guide track means 107, running therealong on rollers 110, 111 and being driven by drives 120, 121 connected by lines 122, 123 to a power plant (not shown).

In this embodiment, the ballast excavating means 144 comprises bucket loader 124 and hydraulic adjusting drive 154 for operating the bucket loader. Carriage 113 supports the bucket loader on guide track means 107 and further guide track means 148 on carriage 113 displaceably mounts the bucket loader for transverse movement in relation to the carriage. The bucket loader has a bucket 145 whose receiving and discharging side faces an end of conveyor band 130. This arrangement is extremely efficient since the bucket is capable of readily excavating and receiving ballast 101 and of discharging sand or new ballast delivered thereto by conveyor band 130. Even if the sub-grade in reconditioning zone 103 is very poor, the outcome of the work is not affected thereby and the bucket is capable of picking up all sizes of stones that may be intermixed with regular ballast and mud in a track bed to be reconditioned. By suitably inclining the bucket, the bucket loader may also be used for planing the sand or ballast simply by longitudinally displacing it on the stationary train, with the lower edge of the bucket engaging the surface of the bed. Since the conveyor band is connected for moving in unison with the bucket loader, the bucket may be emptied over the shortest possible path and, therefore, with considerable economy.

The illustrated bucket loader has a single bucket 145 having a width spanning a length of a track tie, and it further comprises pivot 153 extending in the direction of track 96 and hydraulic drive 152 for pivoting carriage 113 about the pivot. In this way, the ballast bed may be removed completely and uniformly in a single operation by a single longitudinal movement of the bucket loader, the pivoting of the carriage enabling the buckets to adapt to various sub-grade inclinations.

Conveyor band 130 is supported on another carriage 128 longitudinally displaceable along guide track means 107 on rollers 127 and drive 126 connects carriage 113 of the bucket loader to carraige 128 of the conveyor band, the drive being a piston-and-cylinder device adjustable in the direction of track 96 for adjusting the distance between bucket loader 124 and conveyor band 130. The conveyor band end facing bucket 145 is linked to carriage 128 by guide rod 129. In this manner, the bucket conveyor and associated conveyor band are permanently connected with movement in unison but the bucket always has sufficient freedom of movement to enable it to be emptied efficiently.

The end of conveyor band carrier frame 131 of conveyor band 130 is equipped with feed hopper 133 whose discharge port 132 faces the bucket and winch 134 connects this end to carriage 128 for vertically adjusting the conveyor band end in relation to carriage 128. This enables the input end of the conveyor band to be leveled with respect to the bucket.

Arrow 135 indicates the direction of movement of carriages 112, 113 and 128, and another arrow 136 indicates the direction of movement of assembled track section 102 raised off the ballast bed. Conveyors 137 and 138 each corresponding in width to the length of a tie of the assembled track section are mounted on track building vehicle 98 and adjoining freight car 99 to support and convey lifted assembled track section 102, and gantry crane 141 runs on track 139 along a series of freight cars to enable the assembled track section to be replaced by a new track section stored on one of the freight cars. Winch 140 carries the track section on the gantry crane, 142 designating the assembling track section in broken lines in the hoisted position on the gantry crane. Compacting device 143 is mounted on carriage 112 (see FIG. 9).

As shown in the drawing, bucket 145 is pivoted to fork 146 which, in turn, is pivotally mounted on operator's cab 125 of carriage 113. Adjusting elements 147 connect the bucket to the fork and hydraulic drive 154 links the fork to the cab. Bucket loader 124 is transversely displaceable on the carriage along guide track 148 by drive 149 and may be rotated about vertical axis 150. Drive 152 links mounting plate 151 to cab 125 to pivot the bucket loader about shaft 153 extending in the direction of track 96. Another hydraulic drive 154 links fork 146 to the cab 125 and yet another hydraulic drive 155 is linked to bucket adjusting elements 147. In the broken line position indicated at 156, the bucket loader is shown emptying excavated ballast into feed hopper 133 of conveyor band 130. Arrow 157 indicates the direction of movement of bucket loader 124 and its associated conveyor band 130. Sub-grade 158 is shown cleared of ballast behind the bucket loader in the operating direction indicated by arrow 157.

As shown in FIGS. 8 and 9, conveyor band 130 has an end opposite to the end facing the receiving and discharging side of bucket 145, and tilting conveyor band 166 is mounted on freight car 100, the tilting conveyor also extending in the direction of track 96. Pivot 165 mounts the tilting conveyor substantially centrally between the ends thereof on car 100 adjacent track building vehicle 98 and hydraulic lifting drive 167 is to the tilting conveyor band for tilting the same about pivot 165. Guide track means 159 on freight car 100 guides the tilting conveyor for displacement on the car in the direction of track 96, the opposite end of conveyor band 130 being linked to tilting conveyor band 166 for positioning of the opposite conveyor band end above or below an adjacent end of the tilting conveyor. This arrangement is exceedingly simple and assures that the excavated ballast is removed and the new ballast and sand are delivered in a most efficient manner. The reverse movements of removal and delivery are simply coordinated by tilting the tilting conveyor.

In the illustrated embodiment, drive block 160 is displaceably mounted on guide track means 159 on freight car 100 and pivot 165 of tilting conveyor band 166 is supported on the drive block. The drive block runs on rollers 161 on guide track 159 and drive means for the drive block is mounted on the track building vehicle, control lines 177 connecting the drive means to drive block 160. This arrangement provides for the uninterrupted transmission of power to the drive block and enables the conveyor bands to be efficiently designed.

Wagon 162 is displaceably mounted on rollers 163 on guide track means 159 on car 100 and holds container 178. Hydraulic adjustment drive 164 connects the wagon to the drive block. Feed hoppers 133, 170 and 171, 172 are arranged at respective ends of conveyor band 130 and tilting conveyor band 166, the feed hoppers having discharge openings 132, 173, 174 and 175 facing the conveyor band ends. This arrangement enables the conveying direction to be changed easily and smoothly for respectively removing material from, and delivering material to, reconditioning zone 103.

Carrier frame 168 of the tilting conveyor band is pivotally connected to an adjoining end of conveyor band 130 by connecting rod 169. Arrow 176 indicates the direction of displacement of drive block 160 with wagon 162 along guide track 159 on car 100. In FIG. 9, arrow 179, 180 and 181 indicate the direction of displacement of carriages 112, 113 and 128 as well as drive block 160 or ballast is delivered to excavated reconditioning zone 103. Gantry crane 184 carrying tiltable container 183 is mounted for longitudinal displacement on auxiliary rails 182 to supply sand 185 and clean ballast 186, respectively, to the conveyor band arrangement for delivery to zone 103.

The operation of train 97 will partly be obvious from the above description of the structure thereof and will be set forth in more detail hereinbelow:

As in the other embodiments, the train is driven to reconditioning zone 103 and is stopped when frame 104 of track building vehicle 98 spans the zone. Track section 102 is then lifted off the ballast bed after clamping means 114, 115 has gripped the track section and winches 118, 119 are operated to hoist the track section. The lifted track section is then moved in the direction of arrow 136 operating drives 120 and 121 for displacing carriages 112 and 113 along guide track means 107. The front end of the lifted track section is first deposited on conveyor 137 mounted on the track building vehicle in the region of undercarriage 105 and when lifting device 108 reaches its outermost position determined by the end of frame 104, gripping jaws 114 are released and lifting arm 116 is raised. Thereafter, the track section supported first on conveyor 137 and then on conveyor 138 mounted on adjoining freight car 99 is displaced in the direction of track 96 solely by lifting device 109 until the assembled track section can be gripped by winch 140 on gantry crane 141. If the assembled track section is in poor condition, it is moved by the gantry crane for storage on another freight car and a new assembled track section is brought by the gantry crane to car 99 adjacent the track building vehicle. Since lifting device 109 is mounted on carriage 113 which is supports ecavating means 144 and carriage 128 supporting associated conveyor band 130 is coupled thereto for common movement, the removal of ballast from zone 103 may commence immediately by lowering bucket 145 into ballast 101. The bucket is about as wide as the bed, i.e. about 3 meters, and it automatically excavates the bed as the bucket loader is moved in the direction of arrow 157. Whenever filled, the bucket is raised in the broken line position indicated at 156 in FIG. 8 by actuating hydraulic drives 154 and 155. When the bucket is above feed hopper 133, conveying band 130 is moved closer to bucket 145 by actuating drive 126 so that the discharging side of the bucket is suitably aligned with the free hopper. The bucket is then emptied by pivoting it by actuation of drive 155. The excavated ballast is now conveyed by bands 130 and 166 to container 178 wherein it is deposited. Each longitudinal movement of bucket loader 124 is accompanied with a corresponding movement of the conveyor bands and wagon 162. When a container 178 has been filled, it is loaded on gantry crane 184 for removal to a freight car designed for storing the filled containers. The transverse displacement of bucket loader 124 along guide track 148 on carriage 113 makes it possible to work on a wide sub-grade and the pivoting of the bucket loader about axis 153 makes it possible to adapt the bucket to different inclinations of the sub-grade.

After the reconditioning zone has been excavated, the conveyor band movement is reversed, as in the above-described embodiments. First, protective sand layer 185 is applied to sub-grade 158 and, in a like and subsequent operation, clean ballast 186 is applied over the sand layer, the sand and the clean ballast being discharged through opening 132 in feed hopper 133. Bucket 145 is now tilted downwards to use its lower edge as a planing device for the sand or ballast distributed through opening 132 and the planed sand or ballast is compacted by surface compactor 143 which is held by gripping jaw 114 of lifting device 108. When the conveyor band arrangement is used for removal of the ballast, the end of tilting conveyor 166 joining an end of conveyor 130 is positioned below the end of conveyor 130 (FIG. 8) while it is raised thereabove during the reverse movement (FIG. 9).

The use of sand as a protective layer between the sub-grade and ballast of a track bed is conventional and has been found to be advantageous. However, it would also be possible to apply a bitumen, asphalt or like protective layer on the sub-grade instead of, or together with, the sand, and this would be functionally equivalent to applying a sand layer.

What we claim is:

1. A track work train for reconditioning a ballast bed supporting the track and resting on a layer of sand on a sub-grade, the train comprising a track building vehicle and a plurality of freight cars interconnected for common movement along the track, the track building vehicle including an elongated frame extending in the direction of the track and two undercarriages spaced apart in said direction and supporting the vehicle frame for movement on the track, a hoist means mounted on the vehicle frame between the undercarriages and capable of lifting an assembled track section off the ballast bed, the vehicle frame spanning a ballast bed reconditioning zone resulting from the lifting of the assembled track section off the ballast bed, a vertically adjustable ballast bed excavating means mounted on the vehicle frame rearwardly of the hoist means in said direction and a conveyor band associated with the excavating means for sequentially conveying sand and ballast to the reconditioning zone, the conveyor band comprising a portion for sequentially discharging and distributing the conveyed sand and ballast in said zone, guide track means on the vehicle frame for displaceably supporting the hoist means as well as the excavating means and the associated conveyor band for movement along the vehicle frame in said direction, and drive means for separately displaceing the hoist means and the excavating means along the guide track means.

2. The track work train of claim 1, wherein the conveyor band has an input end connected to the ballast bed excavating means and a length at least equal to the distance between the undercarriages.

3. The track work train of claim 1, wherein the guide track means comprises a separate guide track for the hoist means and for the excavating means.

4. The track work train of claim 3, wherein the guide track for the ballast bed excavating means is arranged in a lower portion of the vehicle frame and the guide track for the hoist means is arranged in an upper portion of the vehicle frame.

5. The track work train of claim 3, further comprising a planing device associated with the ballast bed excavating means.

6. The track work train of claim 5, wherein the input end of the conveyor band is associated with the planing device and the conveyor band has an output end projecting beyond the track building vehicle in said direction, the drive means for displacing the excavating means and associated conveyor band being arranged at the output end, and further comprising an additional conveyor band mounted on a respective one of the freight cars connected to the track building vehicle, the output end of the conveyor band being associated with the additional conveyor band.

7. The track work train of claim 6, wherein the drive means for displacing the excavating means and associated conveyor band is a chain drive.

8. The track work train of claim 1, further comprising ballast and sand consolidating means including a vertically adjustable planing device and a compacting device adjacent the planing device, the compacting device being displaceable in said direction.

9. The track work train of claim 8, the conveyor band portion is positioned at the input end, the conveyor band portion being vertically pivotal about an axis extending transversely to the track and the planing and compacting devices being mounted on the vertically pivotal conveyor band portion.

10. The track work train of claim 9, further comprising a carrier frame including an operator's cab for supporting the excavating means and associated conveyor band on the guide track means for movement therealong.

11. The track work train of claim 9 or 10, wherein the planing device and the compacting device are separately vertically adjustable.

12. The track work train of claim 11, wherein the conveyor band, the planing device and the compacting device are supported for transverse displacement on the carrier frame, and further comprising a vertical pivot supporting an end of the conveyor band opposite the input end thereof.

13. The track work train of claim 1, wherein a first series of the freight cars is connected to one end of the track building vehicle and a second series of the freight cars is connected to an end of the track building vehicle opposite to the one end, further comprising conveyor means for assembled track sections on the first series of cars and ballast and sand conveyor means on the second series of cars.

14. The track work train of claim 1, further comprising a conveying apparatus spanning the ballast bed reconditioning zone, the conveying apparatus having an input end, a conveying unit arranged on a respective one of the freight cars and having a delivery end associated with the input end of the conveying apparatus, and the conveying apparatus having an output end arranged above the conveyor band.

15. The track work train of claim 1, wherein the excavating means comprises a bucket loader and hydraulic adjusting drive means for operating the bucket loader, further comprising a carriage supporting the bucket loader on the guide track means and a further guide track means on the carriage for transversely displaceably mounting the bucket loader thereon, the loader having a bucket whose receiving and discharging side faces an end of the conveyor band.

16. The track work train of claim 15, wherein the loader has a single one of the buckets, the single bucket having a width spanning a length of a track tie, further comprising a pivot extending in said direction and supporting the carriage, and a hydraulic drive for pivoting the carriage about the pivot.

17. The track work train of claim 15 or 16, further comprising a drive adjustable in said direction and connecting the carriage to the conveyor band for adjusting the distance between the bucket loader and the conveyor band.

18. The track work train of claim 15 or 16, wherein the hoist means comprises two independently displaceable and vertically pivotal lifting devices, comprising a further carriage supporting one of the lifting devices on the guide track means, the other lifting device being supported on the carriage for the bucket loader, each lifting device having one end linked to a respective one of the carriages adjacent the guide track means and an end opposite to the one lifting device and equipped with a clamping means.

19. The track work train of claim 18, further comprising a winch for pivoting each lifting device in relation to the carriage supporting the lifting device.

20. The track work train of claim 15, further comprising another carriage displaceable along the guide track means, the conveyor band end being linked to the other carriage.

21. The track work train of claim 20, further comprising a winch for vertically adjusting the conveyor band end in relation to the other carriage.

22. The track work train of claim 15, wherein the conveyor band has an end opposite to the end facing the receiving and discharging side of the bucket, further comprising a tilting conveyor band extending in said direction, a pivot mounting the tilting conveyor band substantially centrally between the ends thereof on a respective one of the freight cars adjacent the track building vehicle, a hydraulic lifting drive for tilting the tilting conveyor band about the pivot, and guide track means on the one freight car for displacing the tilting conveyor on said car in said direction, the opposite conveyor band end being linked to the tilting conveyor band for positioning of the opposite conveyor band end above or below an adjacent end of the tilting conveyor band.

23. The track work train of claim 22, further comprising a drive block displaceably mounted on the guide track means on the one freight car, the pivot of the tilting conveyor band being supported on the drive block, drive means for the drive block being mounted on the track building vehicle, and control lines connecting the drive means to the drive block.

24. The track work train of claim 23, further comprising a wagon displaceably mounted on the guide track means on the one freight car, a container on the wagon, a hydraulic adjustment drive connecting the wagon to the drive block, and feed hoppers at the respective ends of the conveyor band and the tilting conveyor band, the feed hoppers having discharge openings facing the conveyor band ends.

25. The track work train of claim 1, further comprising a first conveyor mounted on the track building vehicle frame in the range of one of the undercarriages and a second conveyor mounted on a respective one of the freight cars adjacent the one undercarriage of the track building vehicle, the conveyors being capable of receiving and transporting a respective one of the assembled track sections.

* * * * *